US007594643B2

(12) United States Patent
Ross

(10) Patent No.: US 7,594,643 B2
(45) Date of Patent: Sep. 29, 2009

(54) BALCONY AND STAIRWAY RAILING ASSEMBLIES

(76) Inventor: Nancy A. Ross, 100 Glass St., Dallas, TX (US) 75207

( * ) Notice: Subject to any disclaimer, the term of this patent is extended or adjusted under 35 U.S.C. 154(b) by 0 days.

(21) Appl. No.: 11/653,703

(22) Filed: Jan. 16, 2007

(65) Prior Publication Data

US 2008/0169456 A1 Jul. 17, 2008

(51) Int. Cl.
*E04H 17/14* (2006.01)

(52) U.S. Cl. ..... 256/22; 256/59; D25/38

(58) Field of Classification Search ..... 256/1, 256/21, 22, 59, 65.11, 65.12, 68, 69; 403/49, 403/389; D25/38, 42, 43
See application file for complete search history.

(56) References Cited

U.S. PATENT DOCUMENTS

| | | | | | |
|---|---|---|---|---|---|
| 8,038 | A | * | 4/1851 | Krauser | 256/21 |
| 8,149 | A | * | 6/1851 | Crowell | 256/21 |
| 9,420 | A | * | 11/1852 | Hess | 256/21 |
| 22,448 | A | * | 12/1858 | Nuttall | 256/21 |
| 92,118 | A | * | 6/1869 | Sommer | 256/21 |
| 158,047 | A | * | 12/1874 | Devoe et al. | 256/67 |
| 206,384 | A | * | 7/1878 | Young | 256/22 |
| 243,280 | A | * | 6/1881 | Martin | 256/22 |
| 293,673 | A | * | 2/1884 | Rogers | 256/22 |
| 390,995 | A | * | 10/1888 | Symonds | 256/22 |
| 616,515 | A | | 12/1898 | Williams | |
| 692,461 | A | * | 2/1902 | Lightfeldt | 256/22 |
| 2,520,314 | A | | 8/1950 | Harris | |
| 2,976,018 | A | * | 3/1961 | Dellagala | 256/21 |
| 3,092,372 | A | * | 6/1963 | Cougle | 256/22 |
| D217,984 | S | * | 7/1970 | Pearl | D25/142 |
| 3,745,615 | A | * | 7/1973 | Oberreich | 24/459 |
| 4,022,435 | A | * | 5/1977 | Glass | 256/1 |
| 4,273,465 | A | * | 6/1981 | Schoen | 403/391 |
| 4,386,761 | A | * | 6/1983 | Kato | 256/21 |
| 5,060,961 | A | * | 10/1991 | Bontrager | 280/279 |
| 5,076,545 | A | * | 12/1991 | Bodzin | 256/1 |
| 5,230,500 | A | | 7/1993 | Lin | |
| 5,820,111 | A | * | 10/1998 | Ross | 256/65.11 |
| 5,907,935 | A | | 6/1999 | Elena | |
| 6,059,269 | A | * | 5/2000 | Ross | 256/65.11 |
| 6,394,422 | B1 | * | 5/2002 | Jones et al. | 256/65.01 |
| D468,835 | S | * | 1/2003 | Schiefelbein et al. | D25/38 |
| D542,423 | S | * | 5/2007 | Baur et al. | D25/126 |
| 2003/0132426 | A1 | * | 7/2003 | Kang | 256/22 |
| 2005/0236611 | A1 | * | 10/2005 | Vereide et al. | 256/59 |
| 2006/0214149 | A1 | * | 9/2006 | Hung | 256/22 |

* cited by examiner

*Primary Examiner*—Daniel P Stodola
*Assistant Examiner*—Joshua T Kennedy
(74) *Attorney, Agent, or Firm*—Gardere Wynne Sewell LLP

(57) ABSTRACT

Stairway and balcony railing assemblies are provided with balusters having elongated rod-like leg parts interconnecting baluster ends which may include support trunnions for connecting the balusters to a base and to a railing cap. The baluster legs are interconnected by two part collars which may be assembled to interconnect adjacent balusters and to support ornamental barrier parts. The ornamental barrier parts may comprise multipart members which may be assembled and disassembled by threaded connections to facilitate modular onsite erection of the railing assemblies.

11 Claims, 5 Drawing Sheets

BALCONY AND STAIRWAY RAILING ASSEMBLIES

BACKGROUND OF THE INVENTION

In the development of modern ornamental balcony and stairway railing assemblies, there has been a continuing need for railing assemblies which may be adapted to various structural features at which the railing assemblies are required to be erected. For example, there are several slope angles for stairways which require accommodation by the stairway railing assembly. Still further, there has been a continuing need to develop modular balcony and stairway railing assemblies which may be assembled on site, are adaptable to various applications and do not require custom prefabrication away from the site of the installation of the balcony or stairway railing.

My U.S. Pat. Nos. 5,820,111 and 6,059,269 address the above-mentioned problem with modular balcony and stairway railing assemblies. However, there has been a further need for stairway railing assemblies, in particular, which can accommodate various stairway slope angles. There has also been a desire to provide ornamental railing assemblies which are easy to transport in a disassembled condition and are easy to erect on site to accommodate stairways and balconies of different railing length requirements. It is to these ends that the present invention has been developed.

SUMMARY OF THE INVENTION

The present invention provides improved balcony and stairway railing assemblies.

In accordance with one aspect of the present invention, balcony and stairway railing assemblies are provided with balusters which may be interconnected by two part connector or collar members which can be adapted to be used with balcony railings and which also can be adapted to be used with stairway railings of various slope angles. The baluster connectors or collars are also, preferably, provided in two opposed parts which may be releasably connected together with threaded fasteners and which can be modified slightly to connect balusters of stairway railing assemblies of a wide range of angles. For example, a family of four collars of the above-described type can be provided to accommodate stairway railing angles in the range of about twenty-one degrees to forty-nine degrees (measured from the horizontal).

The present invention also provides a modular balcony and stairway railing assembly which may be made up of balusters which may be interconnected by collars or connectors of a type as described herein, which collars or connectors may also support additional railing barrier parts, such as elongated rods which support one or more ornamental parts of the railing assembly.

Further in accordance with the invention, there are provided balcony and stairway railing assemblies which are particularly modular, may be fabricated and shipped to the site of erection in a dissembled condition and erected onsite easily while accommodating balconies and stairways of different lengths and slope angles, respectively.

Those skilled in the art will further appreciate the above-mentioned advantages and superior features of the invention together with other important aspects thereof upon reading the detailed description which follows in conjunction with the drawings.

DETAILED DESCRIPTION OF THE PREFERRED EMBODIMENTS

Figure 1:
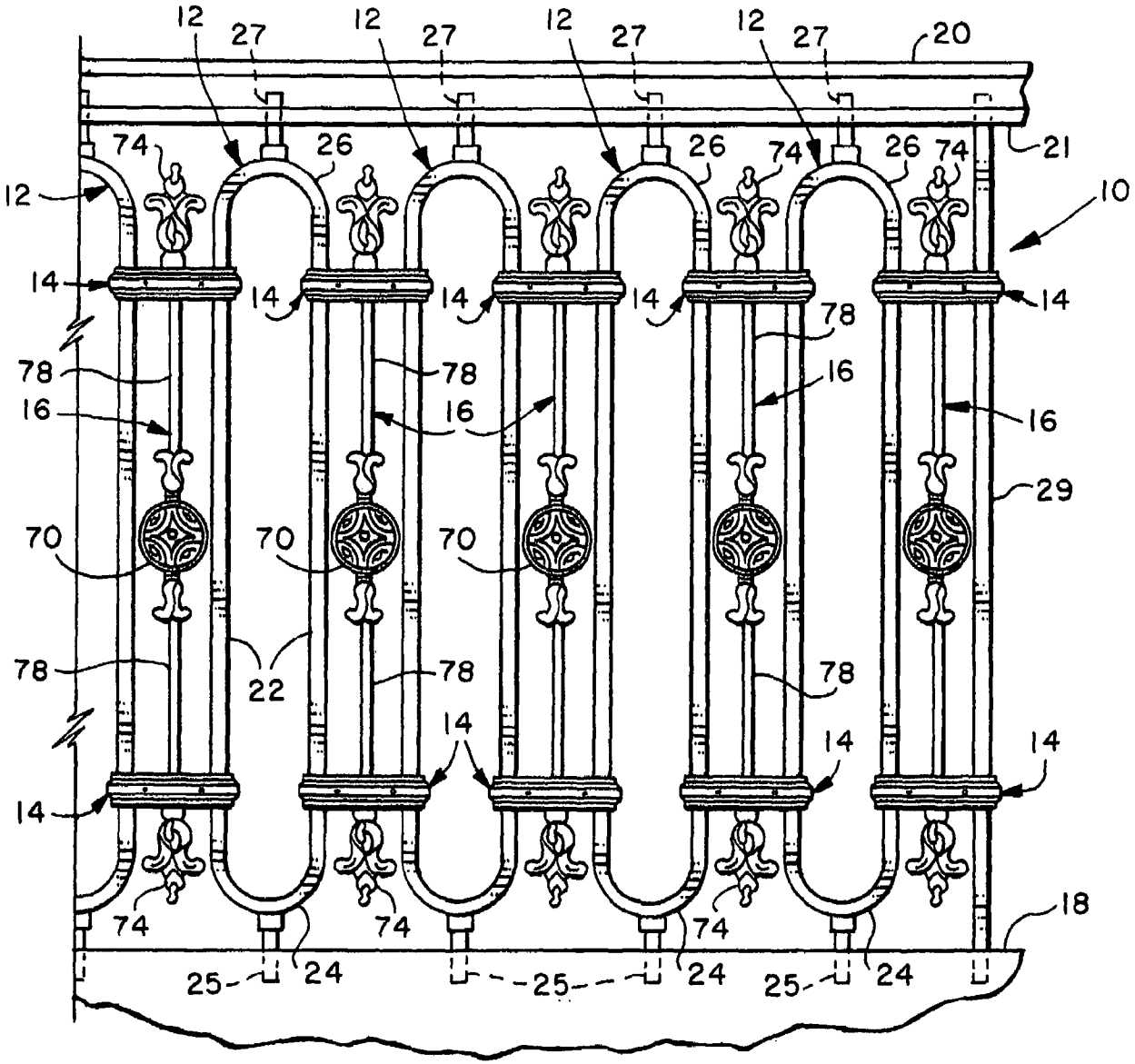
FIG. 1 is a side elevation of a balcony railing assembly in accordance with the invention.

In the description which follows, like parts are marked throughout the specification and drawing with the same reference numerals, respectively. The drawing figures are not necessarily to scale and certain features may be shown exaggerated in scale in the interest of clarity and conciseness.

Referring to FIG. 1, there is illustrated a portion of a balcony railing assembly in accordance with the invention and generally designated by the numeral 10. The railing assembly 10 is characterized by spaced apart vertically extending balusters 12 which are interconnected by connector or collar assemblies in accordance with the invention, each generally designated by the numeral 14. Vertically spaced collars or collar assemblies 14 are preferably two part structures which will be described in further detail hereinbelow. The connectors or collars 14 also support elongated vertically extending modular ornamental barrier parts 16 which will also be described in further detail herein. The modular construction of the balcony railing assembly 10 is advantageous in that any length of railing assembly may be provided for forming a barrier extending between a floor structure 18 and an elongated railing cap 20.

In a preferred embodiment of the balusters 12, each comprises spaced apart vertically extending rod portions 22 interconnected by integral curvilinear top and bottom head parts 24 and 26, which each also include opposed axially aligned trunnion parts 25 and 27, for example. The trunnion parts 25 and 27 are adapted to project into respective bores formed in the floor 18 and the handhold or railing cap 20, as shown. Alternatively, the trunnion parts 25 and 27 may be secured to mounting plates or the like, not shown, which, in turn, may be connected to the floor 18 and the underside 21 of the railing cap 20. In the embodiment shown in FIG. 1, one end of the railing assembly 10 is provided with a terminating rod or stanchion part 29. Alternatively, one or both ends of a railing assembly, such as the railing assembly 10, may terminate with balusters 12, for example. The parts 16 also, of course, serve as barrier parts together with the vertically extending legs 22 of the baluster parts 12. The integral opposed curvilinear heads 24 and 26 also serve as barrier parts for the railing assembly 10.

Figure 2:
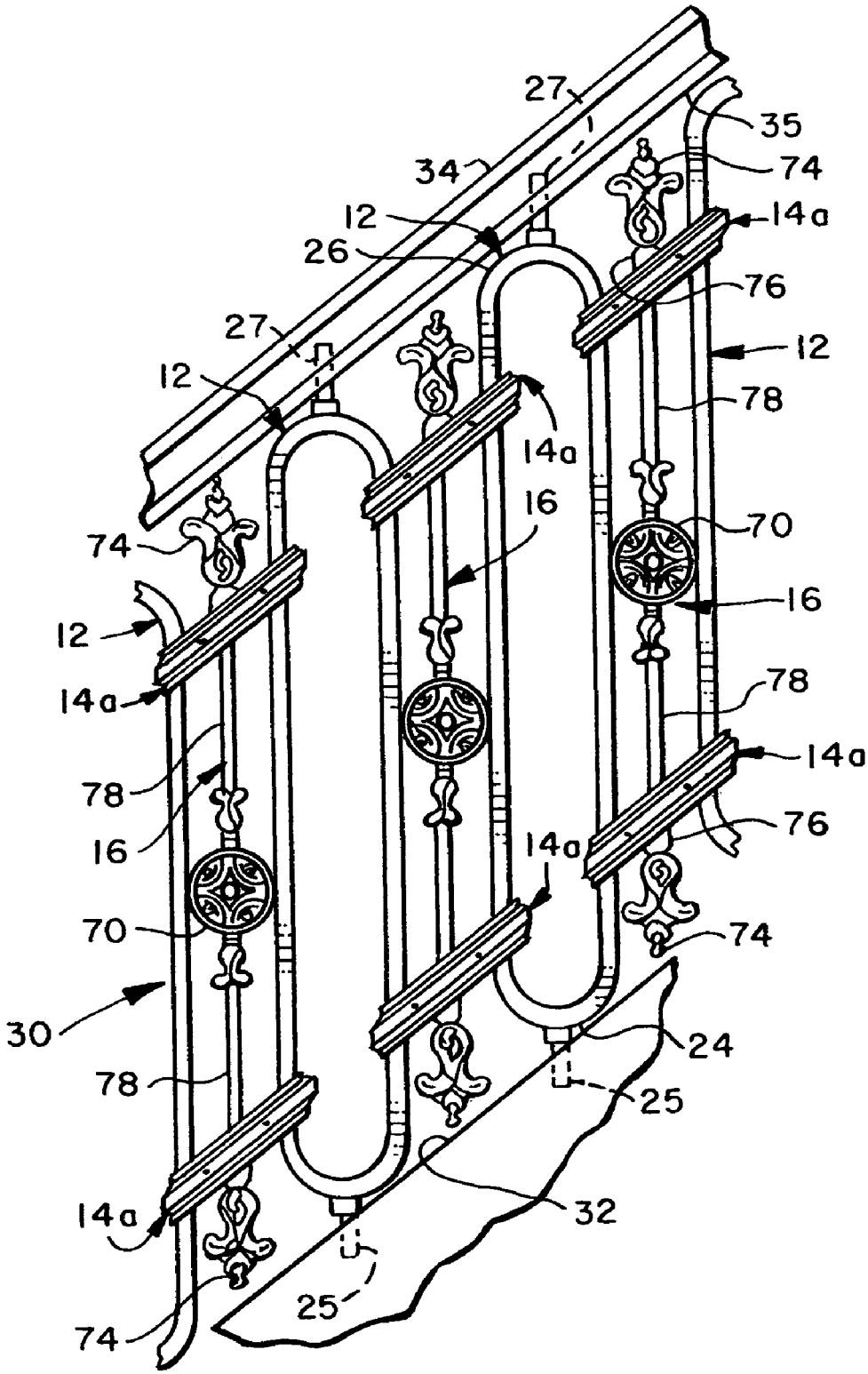
FIG. 2 is a side elevation of a stairway railing assembly in accordance with the invention.

Referring now to FIG. 2, the baluster parts 12 and the ornament parts 16 may be utilized in a sloping stairway railing assembly, generally designated by numeral 30. The overall lengths of the balusters 12 may vary depending on the application as a balcony or stairway railing. Stairway railing assembly 30 is erected between a stairway riser 32 and a railing cap 34 similar to the railing cap 20. In this respect, the opposed trunnions 25 and 27 of the balusters 12 may project into suitable bores formed in the riser 32 and bores opening to the bottom surface 35 of the railing cap 34 in the same manner as provided for the railing assembly 10. Other means of securing the balusters 12 may be provided as mentioned hereinbefore. The balusters 12, when used in a railing assembly such as the railing assembly 30, are interconnected by modified connector or collar assemblies 14*a*, as illustrated. Collar assemblies 14*a* are substantially like the collar assemblies 14 but are modified in shape, as illustrated, for aesthetic purposes and to accommodate the slope angle of the stairway at which the railing assembly 30 is erected.

Figure 3:
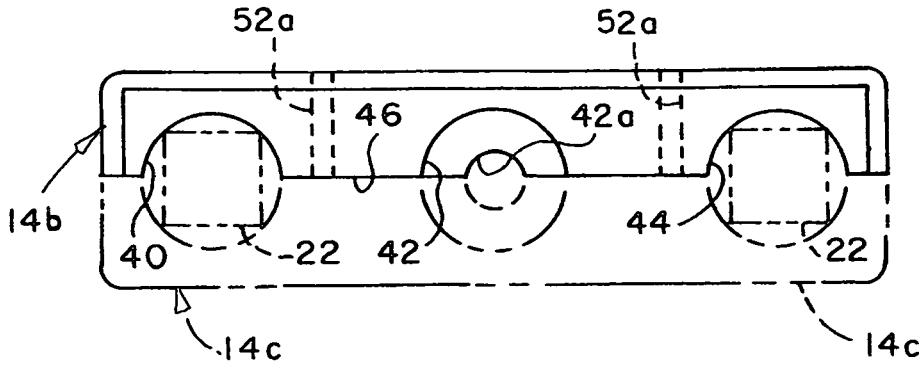
FIG. 3 is a top plan view of one of the parts of a baluster connector or collar in accordance with the invention.
Figure 4:
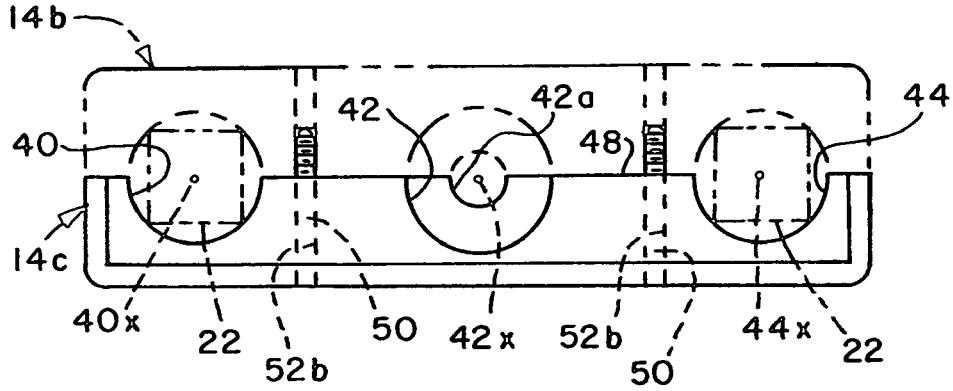
FIG. 4 is a top plan view of the other of the connector or collar parts for a connector or collar in accordance with the invention.
Figure 5:
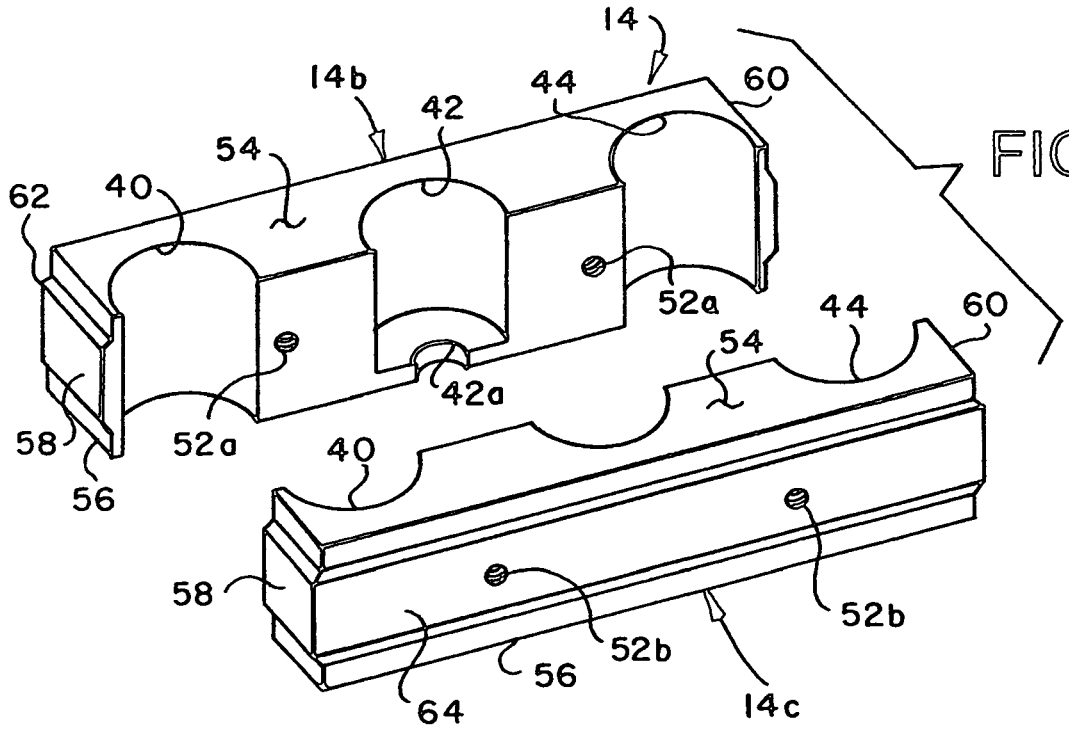
FIG. 5 is an exploded perspective view of the connector or collar parts illustrated in FIGS. 3 and 4.

Referring now to FIGS. 3, 4 and 5, one of the collars or collar assemblies 14 is illustrated in detail. As shown in FIGS. 3, 4 and 5, each connector or collar assembly 14 is characterized by opposed, elongated substantially rectangular collar parts 14*b* and 14*c* which are each provided with semi cylindrical bore portions 40, 42 and 44 so that when the parts 14*b* and 14*c* are mated along cooperating surfaces 46 and 48 substantially circular bores are formed for receiving respective legs 22 of adjacent balusters 12. The respective collar parts 14*b* and 14*c* are assembled and secured to each other, preferably, with elongated headless threaded fasteners 50 which are operably disposed in threaded bores 52*a* and 52*b* of the respective parts 14*b* and 14*c*. One or both ends of fasteners 50 may include tool engaging surfaces. Alternatively, fasteners 50 may comprise conventional machine screws with pan heads, shallow round heads or other aesthetically pleasing shaped heads, in which case one of the bores 52*a* or 52*b* does not require to be threaded. The central bore formed by bore portions 42 includes a stepped bore portion 42*a* of reduced diameter and the bores formed by portions 40, 42, 42*a* and 44 are each provided with a central axis 40*x*, 42*x* and 44*x*, respectively, which axes are normal to opposed somewhat parallel top and bottom surfaces 54 and 56 of the assembled collars 14, as indicated in FIG. 5.

When the collar parts 14*b* and 14*c* are secured together the dimensions of the bores formed by bore portions 40 and 44, with respect to the square cross section of the legs 22, are such as to provide for tightly clamping the collars to the legs of the balusters 12. As will be appreciated by those skilled in the art, the bore axes 40*x*, 42*x* and 44*x* may be formed at an angle to the opposed surfaces 54 and 56, as is the case for the modified collars 14*a*, and this angle may be selected to be one of a series of angles which may allow for a relatively wide range of slopes of stairway railing systems utilizing selected ones of collars 14*a*, for example.

The respective parts 14*b* and 14*c* of collar assembly 14 may be identical and when joined together form the generally rectangular block illustrated in FIGS. 1, 3, 4 and 5 and wherein the block-like collar has, as shown in FIG. 5, opposed end walls 58 and 60 and opposed longitudinal side walls 62 and 64 which may be provided with certain surface interruptions for decorative or aesthetic purposes, as illustrated. Accordingly, the separable collar parts 14*b* and 14*c* enable collars or collar assemblies, such as the collars 14 and 14*a*, to be secured to adjacent balusters 12 so that a railing assembly may be erected on site or prior to shipment to the point of installation. Of course, the separable collar assemblies 14 and 14*a* allow one to take advantage of onsite erection of a railing assembly rather than requiring prefabrication and shipment of large railing assembly panels from a point of manufacture to the point of installation.

Figure 5A:
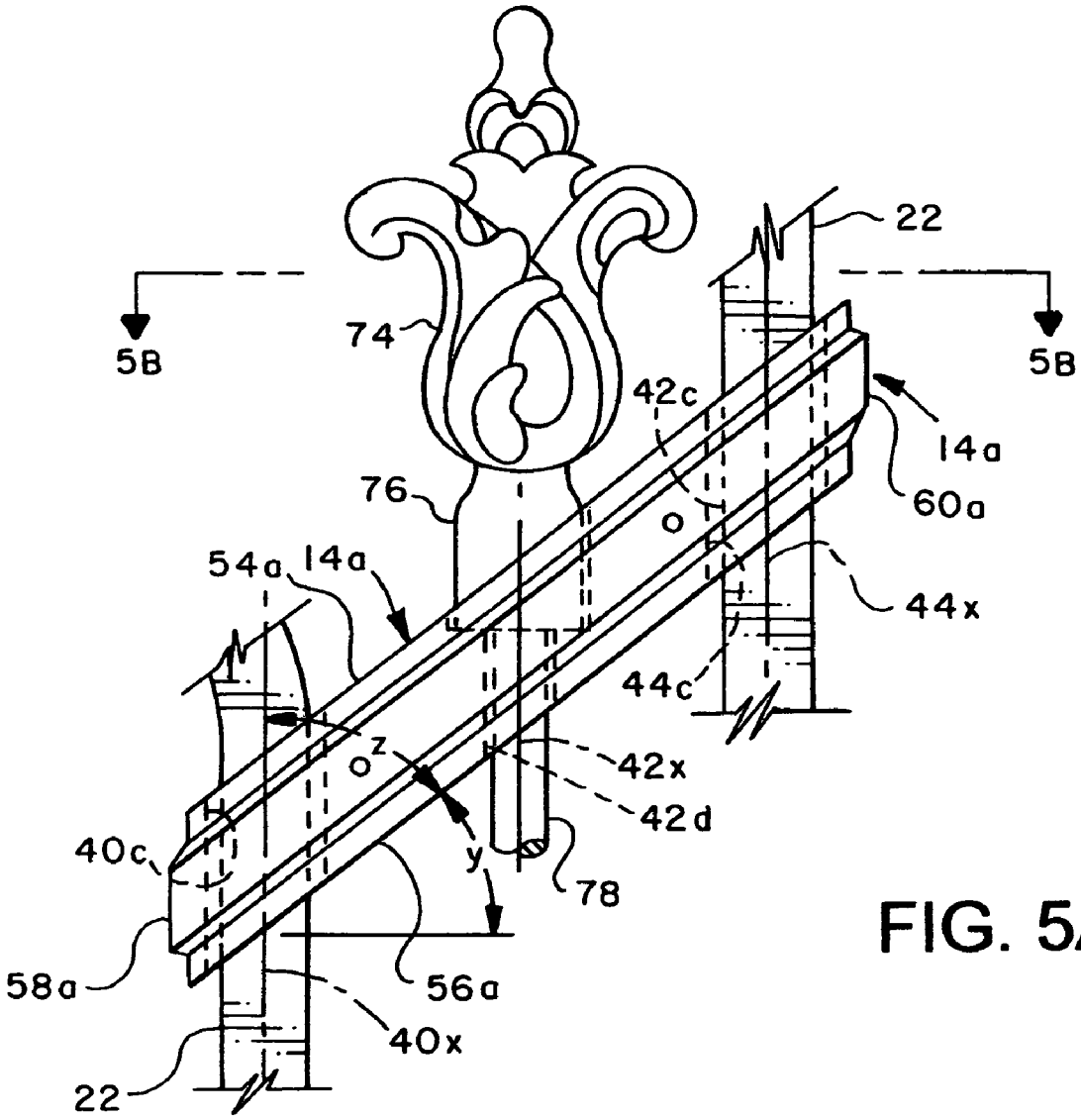
FIG. 5A is a side elevation of another embodiment of a collar in accordance with the invention.
Figure 5B:
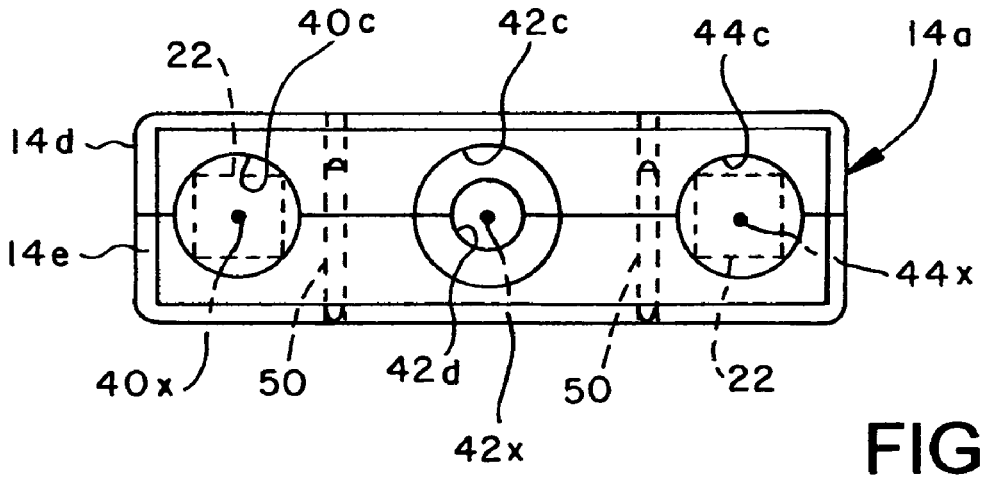
FIG. 5B is a view taken generally from line 5B-5B of FIG. 5A.

Referring to now to FIGS. 5A and 5B, the collar assembly 14*a* is substantially like the collar assembly 14 except it is provided with cooperating parts 14*d* and 14*e* which may be secured together by suitable threaded fasteners, such as headless machine screws 50. The collar assembly 14*a* has opposed top and bottom planar and parallel surfaces 54*a* and 56*a* and opposed end surfaces 58*a* and 60*a*. Baluster receiving bores 40*c*, 42*c*, 42*d* and 44*c* each have respective central vertical axes 40*x*, 42*x* and 44*x*, however, in the embodiment of the collar assembly 14*a*, these axes are at an angle Z, FIG. 5A, with respect to the parallel surfaces 54*a* and 56*a* to accommodate the baluster legs 22 in the same manner, generally, as such legs are accommodated by the collar assemblies 14.

It has been determined in accordance with the present invention that a set of four collars can be provided for respective stairway slope angles y, FIG. 5A, set at twenty-four degrees, thirty-one degrees, thirty-nine degrees and forty-six degrees with respect to the horizontal, when the collar assemblies are secured to a railing assembly. Thus, for such a set of collar assemblies, the angle z between the bore axes 40*x*, 42*x* and 44*x* and the surfaces 54*a* and 56*a* would be sixty-six degrees, fifty-nine degrees, fifty-one degrees and forty-four degrees, respectively. Moreover, each collar assembly 14*a* may accommodate a range of stairway slope angles without interference between the legs 22 of the balusters and the bores of the respective collar assemblies 14*a*, other than that required to clamp the collar assemblies to the baluster legs 22, thanks to the cooperation between the square cross section baluster legs 22 and the cylindrical bores formed by the collar assemblies 14*a*. For example, a collar assembly 14*a* having an angle z, FIG. 5A of sixty-six degrees may accommodate stairway slope angles in a range of twenty-one degrees to twenty-seven degrees from the horizontal. An angle z of fifty-nine degrees accommodates a range of stairway slope angles of between twenty-eight degrees and thirty-four degrees. Still further, a collar assembly 14*a* having an angle z of fifty-one degrees may accommodate a range of stairway slope angles of thirty-five degrees to forty-two degrees and a collar assembly 14*a* having bore axes formed at an angle z of forty-four degrees may accommodate a range of stairway slope angles of forty-three degrees to forty-nine degrees. In all of the above mentioned ranges of stairway slope angles, stairway railing assemblies may be erected with the baluster legs 22 extending vertically. Exemplary dimensions for collar assemblies 14*a* are a collar assembly thickness between surfaces 54*a* and 56*a* of about 1.0 inches, and the diameters of bores 40*c* and 44*c* of 0.875 inches for a baluster leg 22*a* cross section dimension of 0.625 inches width or thickness.

Figure 6:
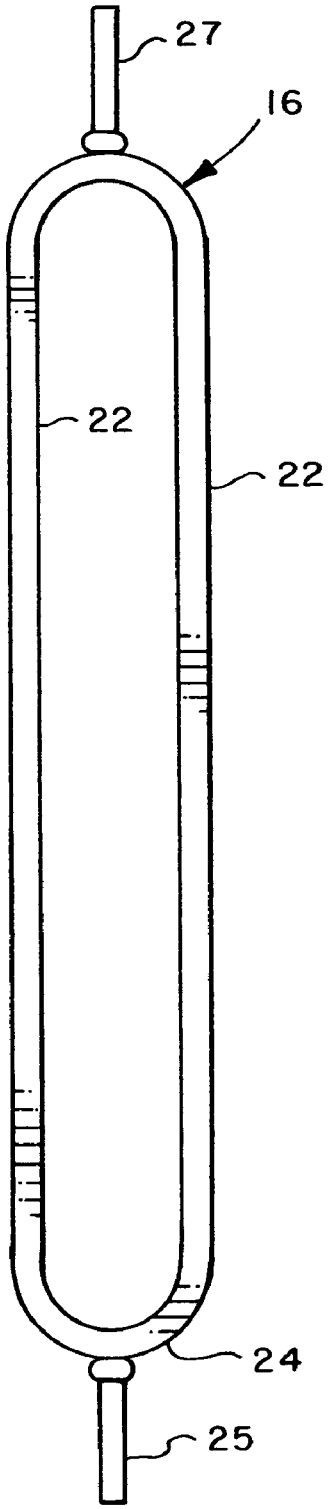
FIG. 6 is a side elevation of a baluster for the balcony and the stairway railing assemblies in accordance with the invention.

Referring briefly to FIG. 6, a baluster 16 is illustrated having a continuous elongated oval shape formed by the substantially linear parallel legs 22 interconnected by opposed curvilinear end or head portions 24 and 26 and trunnion portions 25 and 27. The balusters 16 may be formed of tubular or solid metal having polygonal cross section shapes. In the embodiment illustrated the baluster legs 22 have a square cross section shape, as indicated in FIGS. 3, 4 and 5B.

Figure 7:
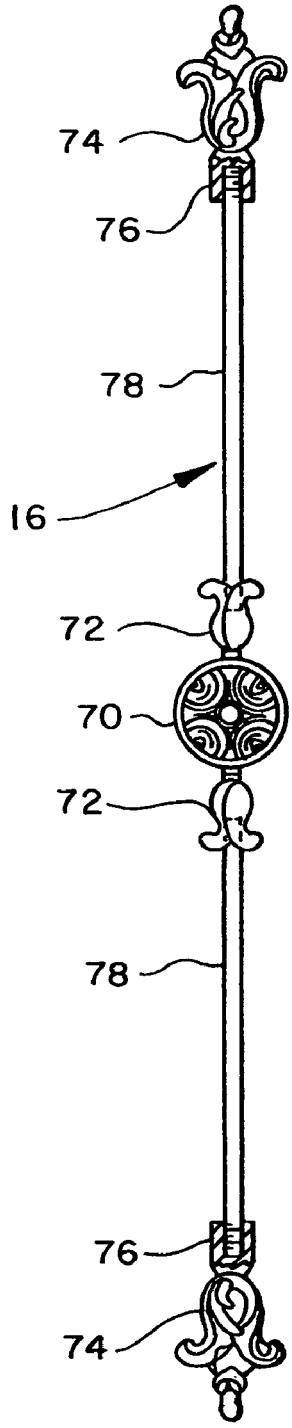
FIG. 7 is a side elevation one of a modular ornamental barrier part for the balcony and railing assemblies of the present invention.

Referring to FIG. 7, an ornamental barrier part 16 will now be described. The ornamental barrier part 16 includes a center medallion part 70 having opposed ornamental bosses 72 which are provided with respective threaded bores and the ornamental barrier part further includes opposed ornaments 74 having respective integral bosses 76 which are cylindrical and are also provided with threaded bores. Barrier parts 16 further include elongated, preferably cylindrical, rod members 78 which are threaded at their opposite ends for connection to the bosses 72 and 76, respectively, as illustrated in FIG. 7, to form the barrier part 16. The bosses 76 of the ornaments 74 are dimensioned to fit within the collar bores 42 and 42*c* and the rod members 78 are dimensioned to fit within and extend through the bore portions 42*a* or 42*d*, respectively, see FIG. 5A, for example. Accordingly, each ornamental barrier part 16 may be assembled with respect to the collars 14 or 14*a* by mounting the ornament parts 74 in the respective bores formed in the collar assemblies 14 or 14*a* and threadedly connecting the ornament parts to the rod parts 78 which may or may not already be connected to the ornament part 70 via the respective bosses 72.

The components of the respective railing assemblies 10 and 30 may be fabricated using conventional manufacturing techniques for conventional engineering materials, such as metals or plastics typically used for ornamental railing systems. The construction and assembly of the railing assemblies 10 and 30 is also believed to be within the purview of one skilled in the art based on the foregoing description. The parts of the railing assemblies described herein are particularly adapted to be configured as substantially horizontal extending railing assemblies such as the balcony assembly 10, as well as stairway railing assemblies, such as the railing assembly 30, having a wide range of slope angles and wherein the respective collar assemblies 14 and 14*a* provided may accommodate a wide range of slope angles as described and shown.

Although preferred embodiments of the invention are disclosed in detail herein, those skilled in the art will recognize that various substitutions and modifications may be made without departing from the scope and spirit of the appended claims.

What is claimed is:

1. A railing assembly for one of a balcony and stairway comprising:

spaced apart balusters extending between a base and an elongated railing cap, said balusters each including a first elongated leg part and a second elongated leg part interconnected by top and bottom head parts to form an enclosed loop such that the top and bottom head parts directly connect said balusters to said railing cap and said base, respectively;

ornamental barrier parts extending between, but not directly connected to, said base and said elongated railing cap;

a first collar assembly interconnecting a first elongated leg part of a first baluster to a first ornamental barrier part and to a second elongated leg part of a second baluster, said first ornamental part being disposed between said first baluster and said second baluster; and a second collar assembly being distinct and spaced apart from said first collar assembly, said second collar assembly interconnecting a first elongated leg part of said second baluster to a second ornamental barrier part and to a second elongated leg part of a third baluster, said second ornamental part being disposed between said second baluster and said third baluster; and said collar assemblies each including two opposed collar parts secured to each other and forming respective spaced apart first, second and third bores for receiving said legs of said balusters and said ornamental barrier part, respectively.

2. The railing assembly set form in claim 1 wherein:

said bores formed in said collar assemblies are substantially cylindrical.

3. The railing assembly set forth in claim 1 wherein:

said collar parts are secured to each other with threaded fasteners.

4. The railing assembly set forth in claim 3 wherein:

said collar parts include threaded bores, respectively, for receiving said fasteners.

5. The railing assembly set forth in claim 1 wherein:

said collar assemblies each include a third bore disposed between said first and second bores for receiving a portion of a barrier part.

6. The railing assembly set forth in claim 1 wherein:

said head parts comprise curvilinear ends integrally joined to said legs.

7. The railing assembly set forth in claim 6 including:

opposed trunnions secured to said ends for securing said balusters to one of said base and railing cap, respectively.

8. The railing assembly set forth in claim 1 wherein:

said ornamental barrier parts are connected to vertically spaced apart ones of said collar assemblies, said barrier parts including opposed ornament parts receivable in respective third bores formed in said collar assemblies and elongated rod parts of said ornamental barrier parts connected to said ornament parts.

9. The railing assembly set forth in claim 8 wherein:

said ornamental barrier parts include an intermediate ornament part secured to opposed ones of said rod parts.

10. The railing assembly set forth in claim 1 wherein:

said railing assembly may be constructed to accommodate a stairway slope angle in a range of about twenty-one degrees to forty-nine degrees by selection of one of plural collar assemblies having bore axes extending at an angle of less than ninety degrees with respect to opposed surfaces of said collar assemblies, respectively.

11. The railing assembly set forth in claim 10 wherein:

sets of four collar assemblies having bore axes at angles with respect to opposed planar top and bottom surfaces of sixty-six degrees, fifty-nine degrees, fifty-one degrees and forty-four degrees accommodate a stairway slope angle range of twenty-one degrees to forty-nine degrees.

* * * * *